US005697819A

United States Patent [19]

Hatagishi

[11] Patent Number: 5,697,819

[45] Date of Patent: Dec. 16, 1997

[54] CONNECTOR WITH REAR HOLDER

[75] Inventor: Yuji Hatagishi, Shizuoka, Japan

[73] Assignee: Yazaki Corporation, Tokyo, Japan

[21] Appl. No.: 552,568

[22] Filed: Nov. 3, 1995

[30] Foreign Application Priority Data

Nov. 15, 1994 [JP] Japan ..... HEI. 6-280766

[51] Int. Cl.[6] ..... H01R 13/436

[52] U.S. Cl. ..... 439/752

[58] Field of Search ..... 439/752, 404, 439/405, 467, 409, 465, 466, 595, 596

[56] References Cited

U.S. PATENT DOCUMENTS 4,413,872 11/1983 Rudy, Jr. et al. ..... 439/467
4,648,679 3/1987 Pelczarski ..... 339/99 R
4,995,830 2/1991 Eckhaus ..... 439/409
5,067,913 11/1991 Sagawa ..... 439/752
5,154,630 10/1992 Kamono et al. ..... 439/752

*Primary Examiner*—Gary F. Paumen
*Attorney, Agent, or Firm*—Sughrue, Mion, Zinn, Macpeak & Seas, PLLC

[57] ABSTRACT

A connector with a rear holder is constituted by a housing having a plurality of terminal reception chambers, and a rear holder attached to the housing. The rear holder acts to protect connection terminals and electric wires connected thereto, and has a locking projecting body projecting on the inner surface thereof. This locking projecting body includes a first projection positioned near a rear end of a pressure contact portion of the respective connection terminals pressure-contacting the electric wire when the rear holder is attached to the housing.

11 Claims, 4 Drawing Sheets

CONNECTOR WITH REAR HOLDER

BACKGROUND OF THE INVENTION

The present invention relates to a connector with a rear holder, and particularly relates to a connector with a rear holder which contains connection terminals and in which the connection terminals can be positively prevented from being deformed or electric wires can be positively prevented from being detached by the tension imparted to the electric wires pressure-contacted by pressure contact blades.

A a connector with a rear holder constituted by a housing for containing a plurality of pressure contact terminals (connection terminals) and a rear holder is conventionally known such a connector as is disclosed in U.S. Pat. No. 4,648,679.

In the connector with a rear holder, as shown in FIG. 7, pressure contact terminals 61 each of which is provided with pressure contact blades 61A, are contained in terminal reception chambers of a housing 60. In each pressure contact terminal 61, a pair of support portions 61B respectively having a pointed projection 61C projecting inward are provided on the opposite sides behind the pressure contact blades 61A. When an electric wire 12 is pressure-contacted by the pressure contact blades 61A, the projections 61C bite into a coating portion of the electric wire 12 at the rear of the pressure-contacted portion, so that the electric wire 12 is prevented from being detached backward.

There has been also known a connector with a rear holder in which the portion of the electric wire 12 pressure-contacted by the pressure contact terminal 61 is pressed from a position above the pressure contact terminal 61 by a not-shown pressing portion of a cover fitted to the housing 60 so that the electric wire 12 can be prevented from being detached upward from the pressure contact terminal 61.

In such a conventional connector with a rear holder, however, there has been a problem that the electric wire 12 is detached backward when an external force is given to the electric wire 12 so as to pull the electric wire 12 backward strongly. That is, in the above-mentioned conventional structure, the electric wire 12 keeps mechanical strength through the portion which is pressed by the pressure contact terminal 61 or the portion where the projections 61C bite into the electric wire 12. Therefore, if the portion where the projects 61C bite into the electric wire 12 is broken, the holding function of the projections 61C is lost. If the electric wire is further pulled backward, the pressure contact blades 61A per se are deformed and opened backward, so that the holding function by the pressure contact is lost.

Even if the electric wire 12 is not detached from the pressure contact terminal 61, the pressure contact terminal 61 per se is made to float upward by the strong force which pulls the electric wire 12 backward. Accordingly an electric contact failure is apt to arise.

SUMMARY OF THE INVENTION

Taking the foregoing problems into consideration, the present invention has an object to provide a connector with a rear holder in which the mechanical strength of connection terminals is improved to prevent electric wires from being detached by external tension, and in which connection terminals can be prevented from floating up.

In order to achieve the above object, according to the present invention, a connector with a rear holder comprises a housing having a plurality of terminal reception chambers and connection terminals respectively received in the terminal reception chambers, each of the connection terminals having a pressure contact portion with side walls facing each other inward from the opposite side ends in the crossing direction of the connection terminal so that an electric wire connected to each of the pressure contact portions and disposed behind the corresponding connection terminal is led out from a rear portion of the housing, and comprises a rear holder openably/closably attached to the housing for protecting the connection terminals and the electric wires, wherein a locking projecting body having a first projections is provided on the rear holder so that the first projection is positioned near the rear ends of the pressure contact portions of the connection terminals when the rear holder is closed.

Preferably, pressing surfaces are provided on the rear holder so that the pressing surfaces contact with at least upper ends of the connection terminals including the pressure contact portions when the rear holder is closed.

Also, preferably, the rear holder is formed integrally with the housing so as to be opened and closed.

Further, the rear holder may be formed separately from the housing so that the housing is inserted into the rear holder horizontally so as to be received therein.

In a connector with a rear holder according to the present invention, a locking projecting body having a first projection is provided on a rear holder, and the first projection is positioned near the rear end of the pressure contact portion of the connection terminal when the rear holder is closed.

As a result, since the locking projecting body is positioned near the rear end of the pressure contact portion of the connection terminal, the pressure contact portion of the connection terminal is restricted from moving, and the pressure contact portion is prevented from being deformed. Accordingly, the pressure contact portion is prevented from being deformed even if tension is imparted to the electric wire, so that the electric wire is positively prevented from being detached backward.

In addition, a pressing surface is provided in the rear holder, and the pressing surface contacts with at least the upper ends of the connection terminal including the pressure contact portion when the rear holder is closed.

As a result, the pressing surface provided on the rear holder presses the connection terminal downward, and restricts the connection terminal from moving upward. Accordingly, there is no fear that the connection terminal will float up even if tension is imparted to the electric wire. It is therefore possible to maintain a reliable contact state between the electric wire and the connection terminal.

When the rear holder is formed integrally with the housing to be opened and closed, it becomes easy to perform the closing work of the rear holder with respect to the housing, so that it is possible to improve workability.

When the rear holder is formed separately from the housing, and the housing is inserted into the rear holder horizontally and received therein, the locking projecting body itself can be more effectively prevented from being deformed or moving backward.

DETAILED DESCRIPTION OF THE INVENTION

Figure 1:
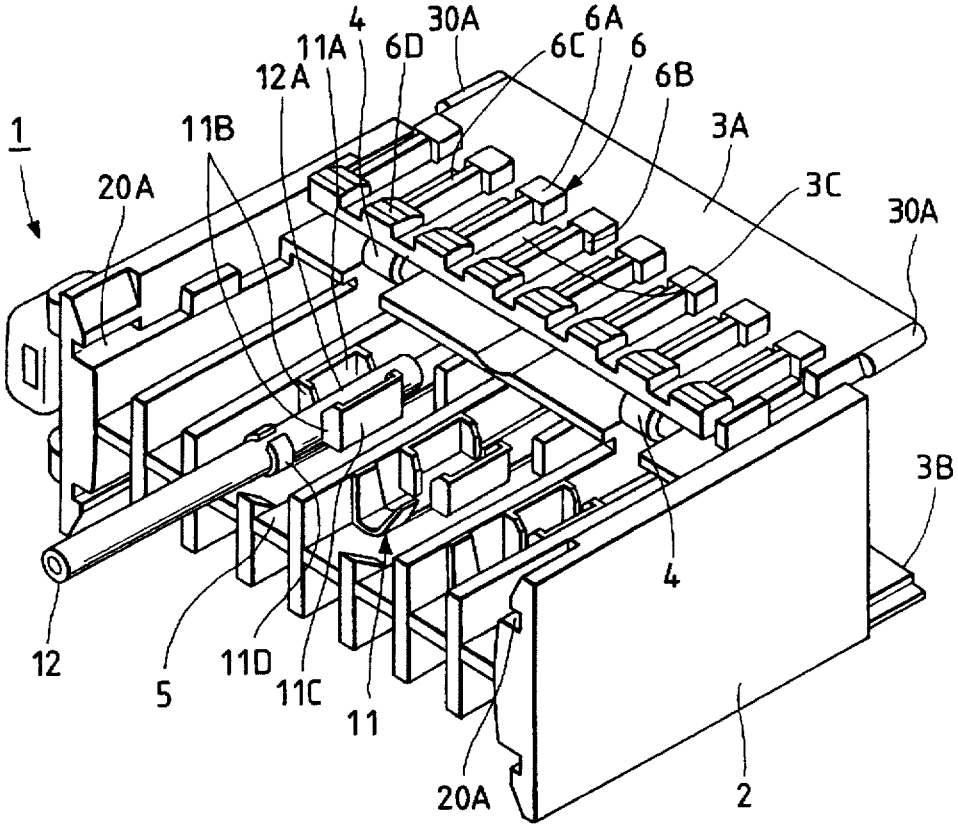
FIG. 1 is a perspective view illustrating a first embodiment of a connector with a rear holder according to the present invention.
Figure 2:
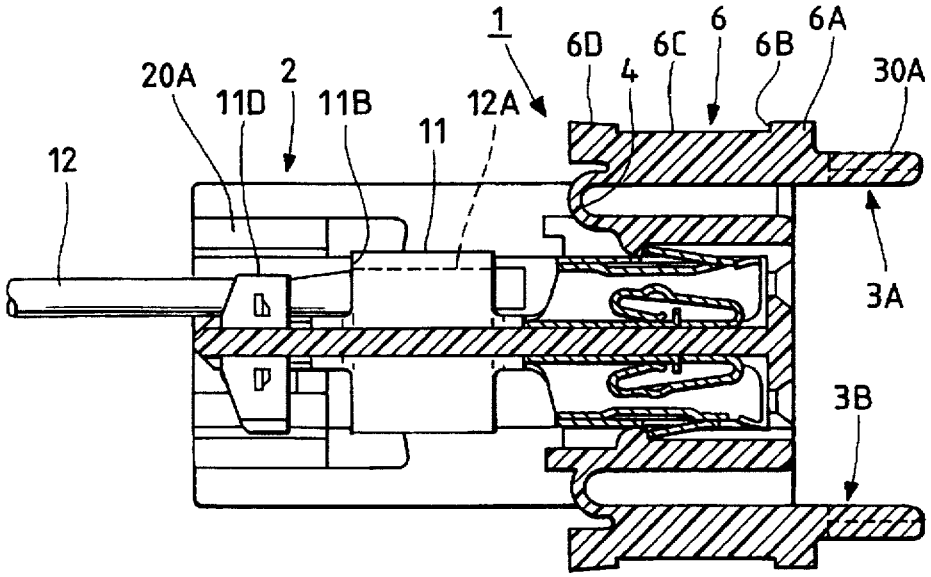
FIG. 2 is a sectional view of the connector with a rear holder in FIG. 1.
Figure 3:
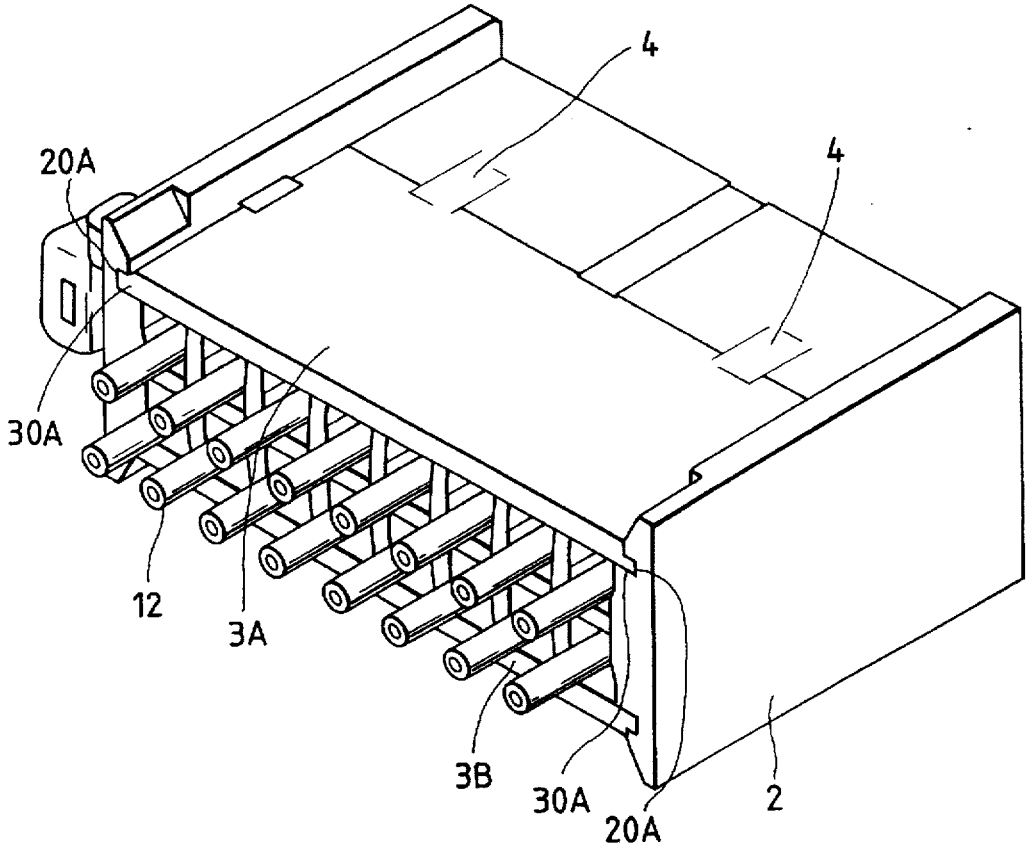
FIG. 3 is a perspective view illustrating the state where the rear holder in FIG. 1 is locked.
Figure 4:
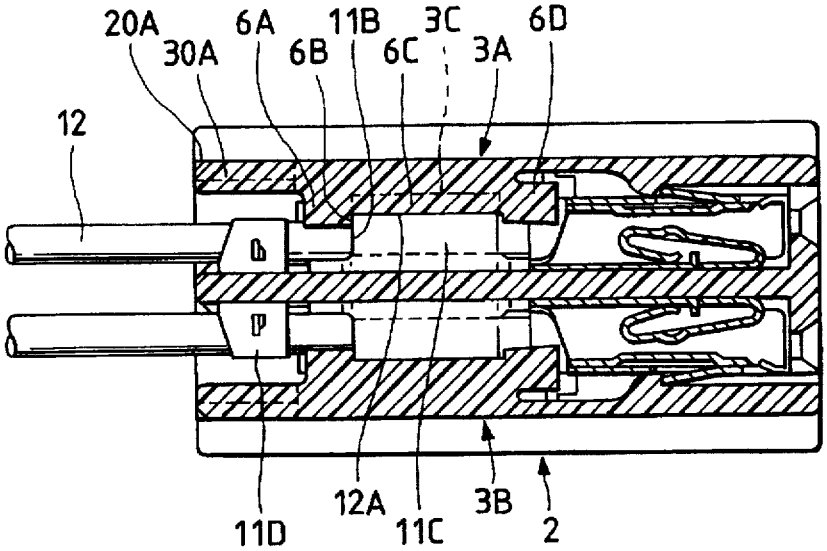
FIG. 4 is a sectional view of the connector with a rear holder in FIG. 3.

A first embodiment of a connector with a rear holder according to the present invention will be described in detail with reference to FIGS. 1 to 4. FIG. 1 is a perspective view illustrating the state where a rear holder is locked temporarily in the first embodiment of the connector with a rear holder according to the present invention; FIG. 2 is a sectional view of FIG. 1; FIG. 3 is a perspective .view illustrating the state where the rear holder is locked regularly; and FIG. 4 is a sectional view of FIG. 3.

As shown in FIGS. 1 and 2, a connector with a rear holder 1 is constituted by a housing 2 having a plurality of terminal reception chambers 5, and rear holders 3A and 3B attached to the housing 2 through hinges 4 so that the rear holders 3A and 3B can be opened and closed. These rear holders 3A and 3B are temporarily locked on the housing 2 in the state where the rear holders 3A and 3B are opened.

The plurality of terminal reception chambers 5 are provided side by side in this housing 2, and a connection terminal 11 is contained in each of the terminal reception chambers 5. This connection terminal 11 is constituted by a pressure contact portion 11A having side walls facing each other inward from both the side ends in the crossing direction of the connection terminal, an electric contact portion (not-shown) disposed in front of the pressure contact portion 11A, and a fastening portion 11D disposed behind the pressure contact portion 11A. In addition, a pocket portion for receiving the electric contact portion of the connection terminal 11 is formed in the front portion of each terminal reception chamber 5. In addition, locking grooves 20A are provided in the opposite ends of the housing 2, respectively.

The pressure contact portion 11A of each connection terminal 11 is constituted by a pair of side walls 11C extended in the longitudinal direction, and a pair of rear end walls 11B formed integrally with the side walls 11C and disposed perpendicularly to this longitudinal direction. Pressure contact blades are formed at the inside top ends of the pair of rear end walls 11B respectively. An electric wire 12 is pressure-contacted by the pressure contact portion 11A, extended toward the rear of the connection terminal 11, and led out from the rear end of the housing 2.

Further, the rear holder 3A acts to protect the connection terminals 11 and the electric wires 12 connected thereto, and has a locking projecting body 6 projecting from the inner surface thereof. This locking projecting body 6 is constituted by a plurality of first projections 6A disposed side by side, second projections 6C connected to the side surfaces of the respective first projections 6A, and third projections 6D connected to the respective second projections 6C. Pressing surfaces 3C for pressing the respective connection terminals 11 from above are formed around the roots of the respective second projections 6C. In addition, locking side pieces 30A to be locked in the respective locking grooves 20A of the housing 2 are provided on the opposite sides of the rear holder 3A respectively. The rear holder 3B provided oppositely to the rear holder 3A has a similar structure, and the description thereof will be therefore omitted.

Here, the positional relationship between the first, second and third projections 6A, 6C and 6D will be described. In the approximately rectangular first projection 6A, a side surface to which the second project 6C is connected forms a rear portion wall 6B. That is, this rear portion wall 6B is formed at such a position that the rear portion wall 6B is located near the rear end walls 11B of the corresponding connection terminal 11 when the opened rear holder 3A is pivoted around on the hinges 4 so as to be closed and locked on the housing 2.

The second projection 6C is a projection extended in the longitudinal direction, and is formed at such a position that the top end thereof contacts with the electric wire 12 pressure-contacted to the pressure contact portion 11A of the corresponding connection terminal 11 when the rear holder 3A is locked on the housing 2.

The approximately rectangular third projection 6D is formed at such a position that the top surface thereof contacts with the electric wire 12 located in front of the pressure contact portion 11A of the corresponding connection terminal 11 when the rear holder 3A is locked on the housing 2.

Next, the assembly of the connector with a rear holder 1 will be described. For the assembly of the connector with a rear holder 1, the connection terminals 11 are received in the respective terminal reception chambers 5 of the housing 2, and the electric wires 12 are pressure-contacted to the pressure contact portions 11A of the connection terminals 11 respectively. Next, the electric wires 12 are fastened by the fastening portions 11D respectively, and the electric wires 12 are led out from the rear portion of the housing 2.

Thereafter, the opened rear holder 3A is pivoted on the hinges 4 as shown in FIG. 3, and the locking side pieces 30A provided on the opposite sides of the rear holder 3A are locked in the locking grooves 20A provided on the opposite sides of the housing 2, so that the rear holder 3A is locked on the housing 2. The rear holder 3B is closed and locked on the housing 2 in the same manner. Thus, the assembly of the connector with a rear holder 1 is completed.

The operation of the connector with a rear holder 1 arranged thus will be described with reference to FIGS. 1 to 4.

The rear portion walls 6B of the respective first projections 6A of the locking projecting body 6 are positioned near the rear end walls 11B of the respective connection terminals 11 mounted in the housing 2 when the rear holder 3A is closed. As a result, it is possible to positively prevent the deformation of the pressure contact terminals or the detachment of the electric wires. That is, when tension is exerted on the pressure-contacted electric wires 12, backward deformation stress acts on the rear end walls 11B. However, the rear portion walls 6B of the respective first projections 6A of the rear holder 3A are positioned near the rear end walls 11B of the connection terminals 11 so as to prevent the rear end walls 11B from moving and being deformed backward.

In addition, the top ends of the second projections 6C provided adjacently at the rear of the first projections 6A in the locking projecting body 6 contact with the upper surfaces 12A of the electric wires 12 pressure-contacted to the pressure contact portions 11A of the connection terminals 11 respectively so as to press the electric wires 12 downward. As a result, the electric wires 12 are prevented from floating upward, so that the connection state with the connection terminals 11 can be positively prevented from being lost.

Further, the pressing surfaces 3C formed around the roots of the second projections 6C of the locking projecting body 6 contact with the upper ends of the side walls 11C forming the pressure contact portions 11A of the respective connection terminals 11 or the upper ends of the rear end walls 11B so as to press the pressure contact portions 11A downward. As a result, the pressure contact portions 11A are held between the bottom portions of the terminal reception chambers 5 and the pressing surfaces 3C respectively so as to positively prevent the connection terminals 11 from floating up. The rear holder 3B operates in the same manner, and hence the description will be omitted.

Next, a second embodiment of the connecter with a rear holder according to the present invention will be described with reference to FIG. 5. Although one of rear holders will be described, the other rear holder opposite thereto has a similar structure.

Figure 5:
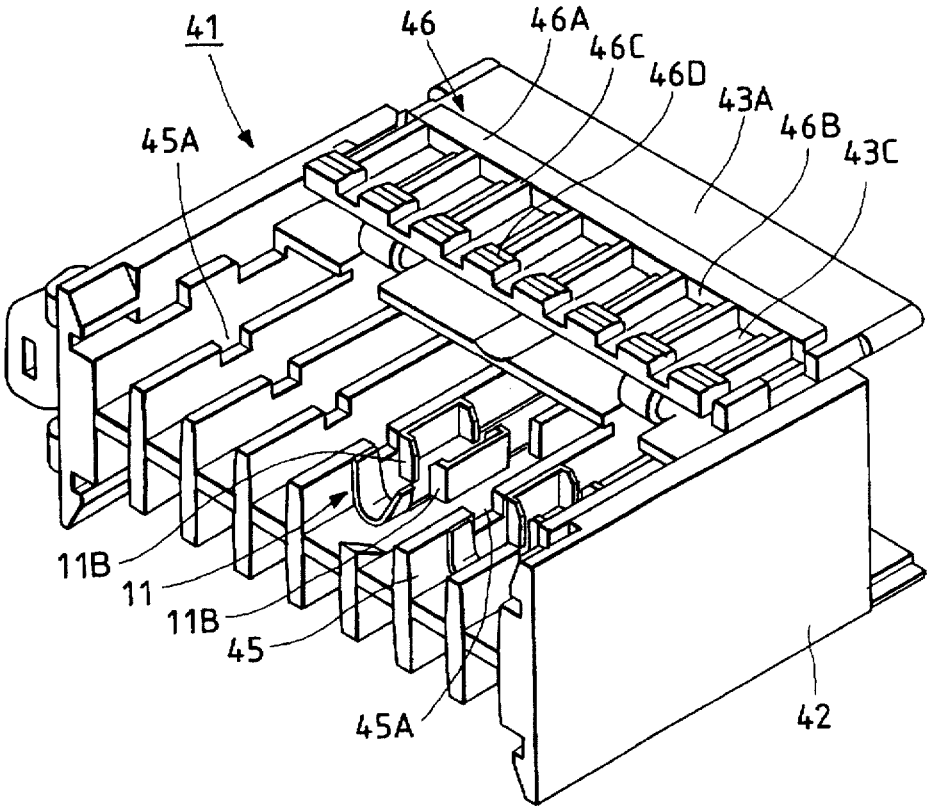
FIG. 5 is a perspective view illustrating a second embodiment of a connector with a rear holder according to the present invention.

As shown in FIG. 5, a connector with a rear holder 41 has a housing 42 for receiving connection terminals 11 between a plurality of partitions 45 each of which has a notch portion 45A at the rear upper end of the partition, and a rear holder 43A formed integrally with the housing 42 and on the front-side upper wall of the housing 42.

This rear holder 43A has a locking projecting body 46 on the inner surface. This locking projecting body 46 is constituted by a first projection 46A extended in the longitudinal direction of the rear holder 43A, a plurality of second projections 46C connected to the side surface of the first projection 46A, and third projections 46D connected to the second projections 46C respectively.

When the opened rear holder 43A is closed, the first projection 46A of the locking projecting body 46 fits into the plurality of notch portions 45A provided in the respective partitions 45. In this fitting state, a rear portion wall 46B of the first projection 46A is positioned near rear end walls 11B of the connection terminals 11 mounted in the housing 42. Consequently, when electric wires are pressure-contacted, a force to deform the rear end walls 11B backward acts because of the tension given to the electric wires, but the rear portion wall 46B of the first projection 46A positively prevents the rear end walls 11B from moving and being deformed backward.

Since the first projections 46A is fitted into the notch portions 45A of the partitions 45, double locking is realized. Therefore, the first projections 46A itself is prevented from being deformed or moving backward so as to realize firmer restriction. The second projections 46C, the third projections 46D and pressing surfaces 43C operate in the same manner as the second projections 6C, the third projections 6D and the pressing surfaces 3C in the above-mentioned first embodiment.

Next, a third embodiment of the connector with a rear holder according to the present invention will be described with reference to FIG. 6.

Figure 6:
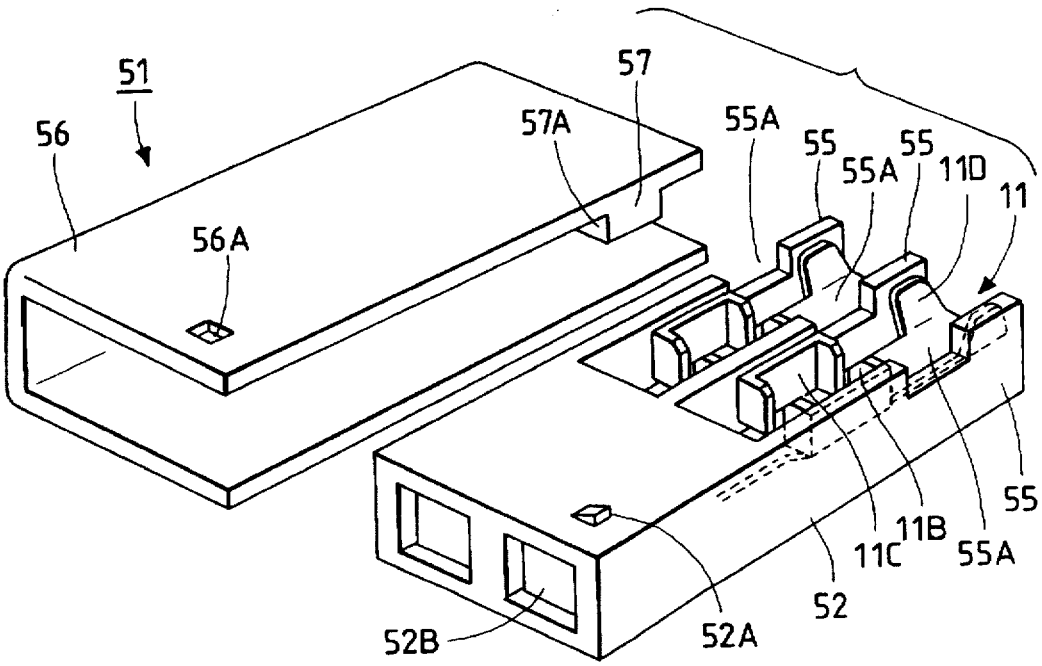
FIG. 6 is a perspective view illustrating a third embodiment of a connector with a rear holder according to the present invention.
Figure 7:
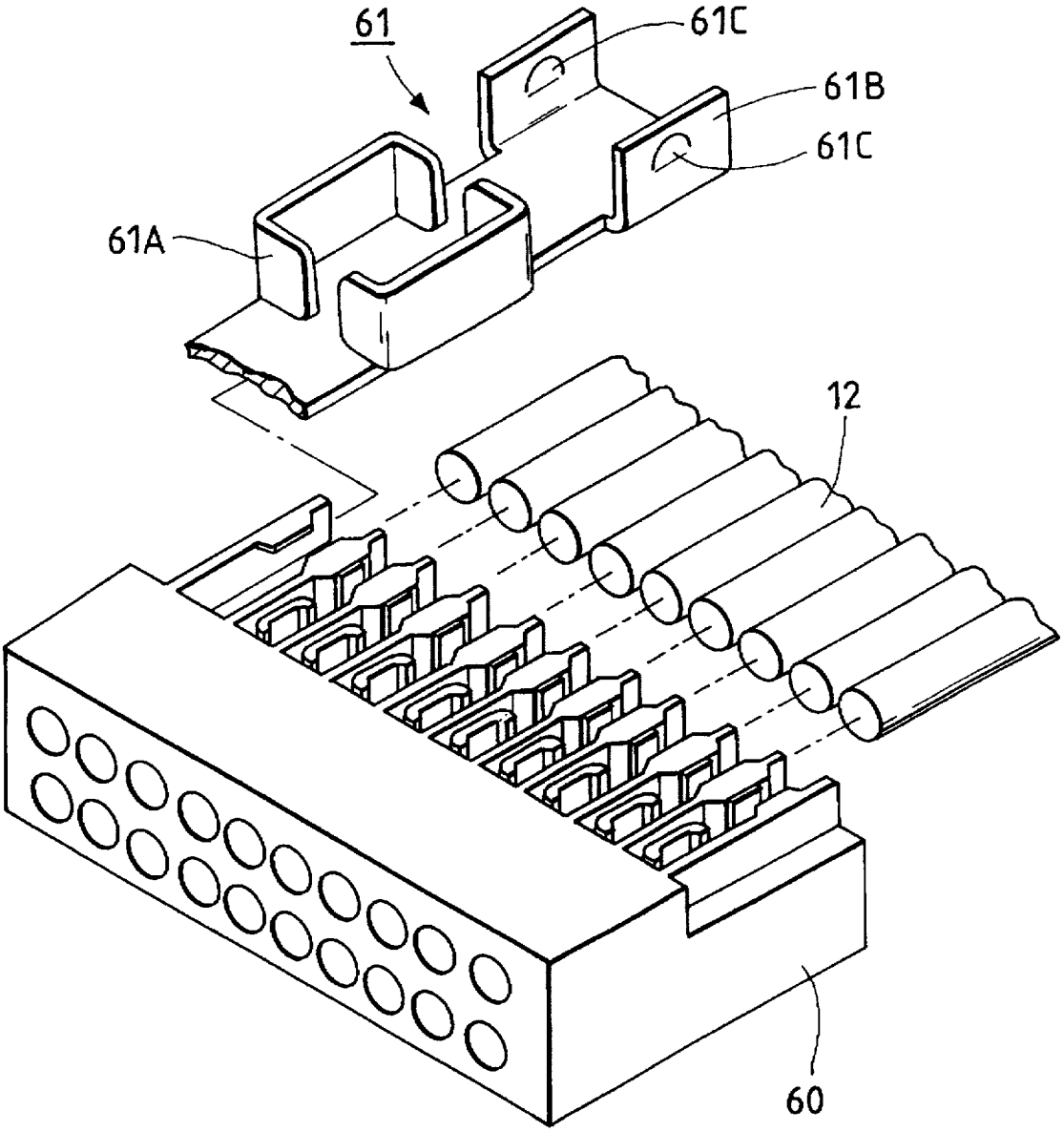
FIG. 7 PRIOR ART
FIG. 7 is an exploded perspective view of a conventional connector with a rear holder.

As shown in FIG. 6, a connector with a rear holder 51 is constituted by a housing 52 for receiving connection terminals 11 between a plurality of partitions 55 each of which has a notch portion 55A at the rear upper end of the partition, and a rear holder 56 approximately U-shaped and formed separately from the housing 52. This rear holder 56 can receive the housing 52. The housing 52 from which electric wires are led out at the rear portion is inserted horizontally from one side surface of the rear holder 56.

A pillar-like locking projection 57 extended in the direction of insertion of the housing 52 is provided to project on the inner surface of the upper wall of the rear holder 56. When the housing 52 is inserted into the rear holder 56, the pillar-like locking projection 57 engages with the plurality of the notch portions 55A. In addition, when the housing 52 is inserted into the rear holder 56, a locking projection 52A provided on the upper wall of the housing 52 engages with a locking hole 56A provided in the upper wall of the rear holder 56, so that the housing 52 is fitted and locked into the rear holder 56.

In this locked state, a rear portion wall 57A of the pillar-like locking projection 57 is positioned near rear end walls 11B of connection terminals 11 mounted in the housing 52. Consequently, when electric wires are pressure-contacted, a force to deform the rear end walls 11B backward acts thereon because of the tension given to the electric wires, but the rear portion wall 57A of the pillar-like locking projection 57 prevents the rear end walls 11B from moving and being deformed backward. Since the pillar-like locking projection 57 is fitted into the notch portions 55A of the partitions 55, double locking is realized. Therefore, the pillar-like locking projection 57 itself is prevented from being deformed or moving backward so as to perform firmer restriction.

Although the rear portion wall of the locking projecting body or the pillar-like locking projection is positioned near the rear end wall of the terminal pressure contact portion when the rear holder is closed or inserted in the above-mentioned embodiments, the rear portion wall may be designed to contact with the rear end wall.

As has been described above, according to the connector with a rear holder according to the present invention, a locking projecting body having a first projection is provided on a rear holder, and the first projection is positioned near the rear end of pressure contact portion of connection terminal when the rear holder is closed.

As a result, the pressure contact portion of the connection terminal is restricted from moving, so that the pressure contact portion can be positively prevented from being deformed. Accordingly, the pressure contact portion is prevented from being deformed even if tension acts on the electric wire, so that the electric wire can be prevented from being detached backward.

In addition, a pressing surface is provided in the rear holder, and the pressing surface contacts with at least the upper ends of the connection terminal including the pressure contact portion when the rear holder is closed.

As a result, the connection terminal is pressed downward, and the connection terminal is restricted from moving upward. Accordingly, there is no fear that the connection terminal floats up even if tension acts on the electric wire. It is therefore possible to maintain a reliable electric contact state.

When the rear holder is formed integrally with the housing so as to be opened and closed desirably, it becomes easy to close the rear holder with respect to the housing, so that it is possible to improve the workability.

When the rear holder is formed separately from the housing, and the housing is inserted into the rear holder horizontally so as to be received therein, the locking projecting body itself can be prevented from being deformed or moving backward, so that the state of more effective electric connection can be maintained.

What is claimed is:

1. A connector with a rear holder, comprising:

a housing;

a plurality of terminal reception chambers disposed in said housing;

a plurality of connection terminals respectively receivable in said terminal reception chambers, each of said connection terminals having a pressure contact portion including opposing end walls defining a slot therebetween in which an insulated portion of an electric wire is retained, said electric wire extending from a rear portion of said housing when said electric wire is retained in said slot;

a rear holder attachable to said housing for protecting said connection terminals and said electric wire, said rear holder including projecting means for abutting against a rear side of said end walls of said terminals to prevent rearward movement thereof when said rear holder is attached to said housing.

2. A connector with a rear holder according to claim 1, further comprising a plurality of pressing surfaces provided on said rear holder so that said pressing surfaces contact at least upper ends of said pressure contact portion of each of said connection terminals when said rear holder is attached to said housing.

3. A connector with a rear holder according to claim 1, wherein said rear holder is formed integrally with said housing so as to be opened and closed.

4. A connector with a rear holder according to claim 2, wherein said rear holder is formed integrally with said housing so as to be opened and closed.

5. A connector with a rear holder according to claim 1, wherein said rear holder is formed separately from said housing so that said housing is inserted into said rear holder horizontally so as to be received therein.

6. A connector with a rear holder according to claim 2, wherein said rear holder is formed separately from said housing so that said housing is inserted into said rear holder horizontally so as to be received therein.

7. A connector with a rear holder according to claim 1, further comprising a plurality of second projections connected to said projecting means, said second projections contacting a portion of said electric wire retained by said pressure contact portion of each of said connection terminals when said rear holder is attached to said housing.

8. A connector with a rear holder according to claim 7, further comprising partitions with notches for partitioning said housing to form said terminal reception chambers, said projecting means being fitted in said notches when said rear holder is attached to said housing.

9. A connector with a rear holder according to claim 5, further comprising partitions with notches for partitioning said housing to form said terminal reception chambers, said projecting means being fitted in said notches when said rear holder is attached to said housing.

10. A connector with a rear holder according to claim 1, wherein said projecting means includes a single elongated projection.

11. A connector with a rear holder according to claim 1, wherein said projecting means comprises a plurality of individual projections.

* * * * *